United States Patent [19]

Ecker

[11] 3,955,663

[45] May 11, 1976

[54] INCREMENTAL ADVANCE MECHANISM

[75] Inventor: Mario Enrique Ecker, Poughkeepsie, N.Y.

[73] Assignee: International Business Machines Corporation, Armonk, N.Y.

[22] Filed: Dec. 23, 1974

[21] Appl. No.: 535,316

[52] U.S. Cl. ..... 197/127 R; 197/1 R; 226/156; 271/266

[51] Int. Cl.[2] ..... B41J 13/03

[58] Field of Search ..... 197/127 R, 133 R, 138 R, 197/1 R; 271/266; 226/146, 149, 156; 335/264, 279; 346/76 R, 136; 192/41 S, 42; 234/35, 36, 37

[56] References Cited

UNITED STATES PATENTS

| | | | |
|---|---|---|---|
| 1,158,991 | 11/1915 | Dixon et al. | 74/128 X |
| 1,542,129 | 6/1925 | Hayes | 226/160 |
| 2,723,013 | 11/1955 | Rogers et al. | 192/41 S |
| 2,884,794 | 5/1959 | May | 74/126 |
| 3,078,734 | 2/1963 | Wiig | 226/156 X |
| 3,126,751 | 3/1964 | Eickhoff | 74/129 |
| 3,421,671 | 1/1969 | Self | 226/76 |
| 3,511,426 | 5/1970 | Whitmore et al. | 226/156 X |
| 3,519,117 | 7/1970 | Smith | 197/138 R |
| 3,520,459 | 7/1970 | McCrady | 346/136 UX |
| 3,632,970 | 1/1972 | Walkow et al. | 346/74 R X |
| 3,787,886 | 1/1974 | McCrady | 197/133 R X |
| 3,802,544 | 4/1974 | Howard et al. | 197/1 R |

OTHER PUBLICATIONS

IBM Disclosure Bulletin; Vol. 16, No. 11, Apr. 1974, pp. 3608–3609, Entitled "Incremental Advance Mechanism," Ecker, Howley, Quinn.

IBM Disclosure Bulletin; Vol. 16, No. 10, Mar., 1974, pp. 3246–3247, Entitled "Multistroke Solenoid," Ecker.

"Spring Clutches for Faster Response;" Leonard, *Product Engineering*, p. 57, Apr. 14, 1958.

"Incrementing Paper Feed Mechanism," Byram, *IBM Technical Disclosure Bulletin*, Vol. 16, No. 3, Aug. 1973, pp. 28–29.

*Primary Examiner*—William H. Grieb
*Attorney, Agent, or Firm*—Thomas F. Galvin

[57] ABSTRACT

Apparatus for incrementally advancing a sheet with high accuracy in which a single actuator causes both the incremental advance of a sheet-advancing roller and also the engagement of the sheet with a printing head upon completion of the incremental advance. The apparatus is particularly adapted to advance thermally sensitive paper past thermal print heads for line-at-a-time printing.

19 Claims, 8 Drawing Figures

INCREMENTAL ADVANCE MECHANISM

FIELD OF THE INVENTION

This invention relates generally to sheet advancing mechanisms. In particular, it relates to thermal printing on thermally sensitive paper where the paper advances transversely of printing heads.

Background of the Prior Art

The advent of reliable and low cost thick film resistors such as Palladium oxide has created new interest in the use of thermal printing. Thermal printing using thick film oxide heater elements offers substantial advantages over impact printing with respect to character resolution, energy efficiency, speed and equipment noise.

The limiting factor both from the standpoint of speed and also precisional accuracy in printing systems using thermal printing heads is the movement of the paper across the printer. Generally, the motion is incremental, i.e., the paper is displaced by a fixed increment, stopped momentarily while printing takes place, moved for the same fixed increment, and so on. Accurate control of these movements is quite difficult, especially within the confines of portable machines, such as data buffers and calculators. In the past, this movement has been accomplished by: moving the print head across and into engagement with the thermally sensitive paper, rotating a drum having the print heads mounted thereon in cooperation with the moving paper (similar to a mimeograph operation) or feeding thermally sensitive ribbon from a spool past a thermal print head in serial fashion. Although these systems have been successful to a certain degree, the control circuitry and logic required is too expensive and complex for satisfactory low cost commercial use; in addition, they are not capable of great precision.

The meaning of the term precision varies with the type of printing to be accomplished. Standard, commercially available printers employ a set of 35 heater elements per character in a 7 × 5 dot matrix array. Printing is accomplished character-by-character using a single character element or with a set of character elements at each position along the message line. Such systems need only be capable of incrementing over the height of a character, which is 4.5mm or more.

Another type of dot printer comprises a single row only of heater elements. A group of characters along the message line is formed by printing simultaneously only a single row of the 7 row dot matrix, followed by incrementing, followed by printing the second row, and so on until the message line is completed. The paper is then indexed twice in a "no-print" mode to obtain the desired spacing between message lines. The incrementing step covers only a single dot spacing of around ½mm or so.

The single row dot printer offers substantial advantages over the matrix printer. The thermal head is smaller and easier to fabricate. The system employs a high degree of common circuitry and control logic and requires fewer moving parts. However, the usual incrementing mechanism employed in matrix printers are incapable of the precise, repeatable indexing of ½mm or less required in single row printers.

Summary of the Invention

It is, therefore, an object of my invention to provide an improved sheet advancing mechanism.

It is a further object of my invention to simplify the operation of thermal printing systems by the use of my improved mechanism.

It is yet another object of my invention to advance paper incrementally and engage it with print heads accurately using a minimum amount of control circuitry.

In accordance with these and other objects, in my novel advance mechanism a single actuator causes both paper advance by a roller and also paper engagement with the printing heads upon completion of the advancing motion. In this way, a single control circuit controls both movements of the paper.

In the preferred embodiment, the apparatus advances thermally sensitive paper transversely of thermal print heads for line-at-a-time printing. The paper is engaged by a rotating roller which is advanced incrementally and unidirectionally by means of an overrunning clutch which is driven by the actuator. The paper is frictionally engaged between the advancing roller and a spring-loaded roller which is rotatably mounted eccentrically with respect to the center axis of the advancing roller. The spring-loaded roller locks the clutch after the incremental movement. The actuator also operates a cam which urges the paper into contact with the print head after the incremental motion is completed. The novel mechanism provides precise, repeatable increments of ⅝mm or less.

DESCRIPTION OF THE PREFERRED EMBODIMENT

Figure 1:
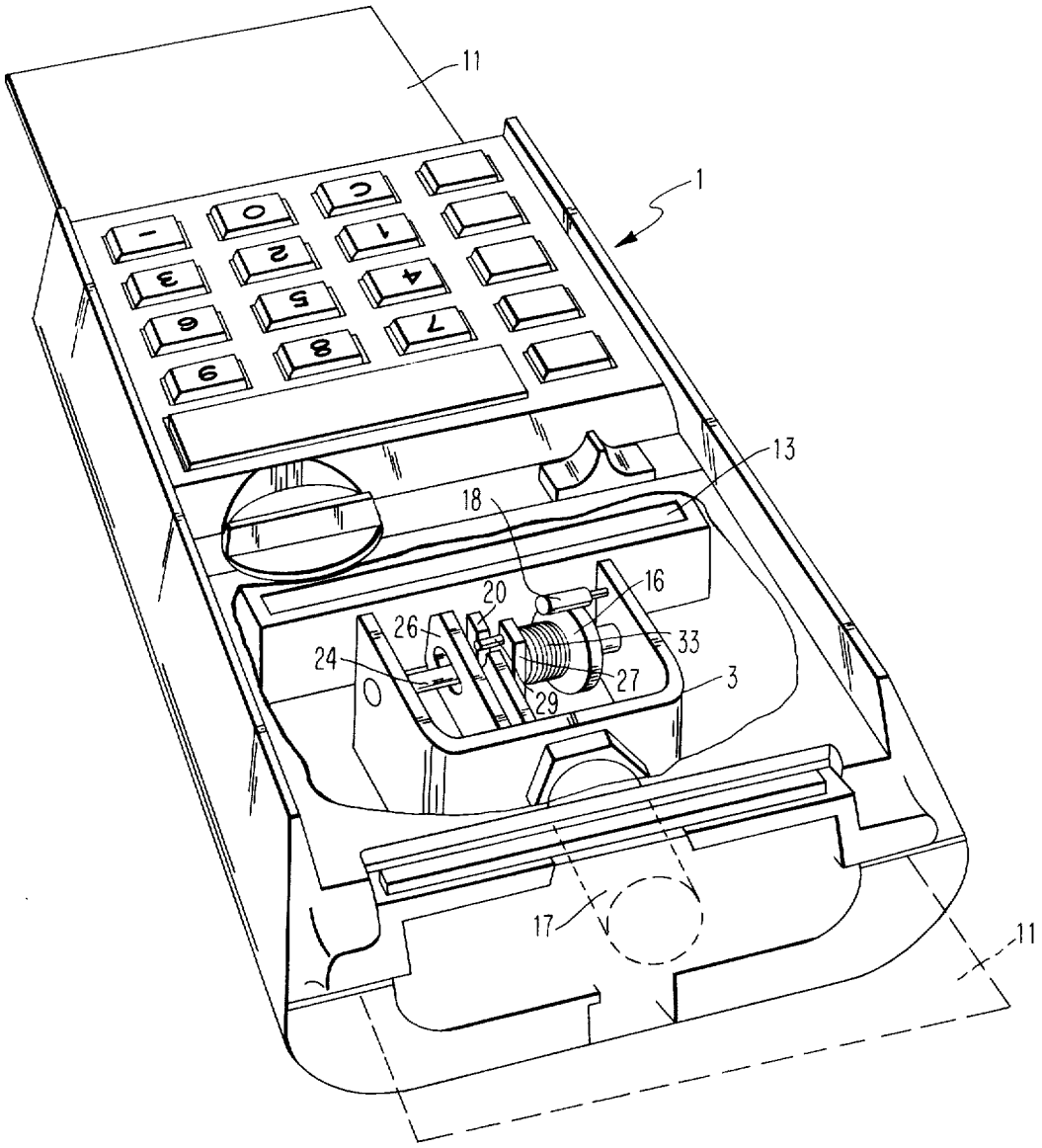
FIG. 1 is a perspective view of a thermal printing system which is partially cut away to illustrate the advance mechanism of my invention.

Referring now to FIG. 1, a thermal printing system 1 implementing the novel sheet advancing mechanism is illustrated. System 1 is a portable data entry system otherwise known as a data buffer in which means are provided for data display by suitable display devices as well as for "hard copy" print out by means of a thermal print head and thermally sensitive paper 11. My invention is not limited to data buffers; all types of devices requiring hard copy, such as calculators, portable printers, etc., are within its purview. In addition, as will become evident when the invention is described in detail, it is advantageous for use in any sheet advancing system which may require both incremental advance as well as the movement of the sheet orthogonally with respect to the direction of incremental advance.

The mechanism is contained within the housing of data buffer 1 and includes a frame assembly 3 to the back of which is mounted solenoid 17. A shaft 24 is mounted on the sidewalls of frame 3 which supports the principal elements of the mechanism. The principal elements which can be seen in FIG. 1 are a sheet advancing roller 16 and a spring-loaded roller 18 through which sheet 11 passes. Sheet 11 may be commercially available thermally sensitive paper or may be a card onto which is bonded thermally sensitive material.

Roller 16 is driven incrementally by a clutch contained in housing 33 which is connected by means of a pair of pins, one of which is identified by the numeral 29 in FIG. 1, to solenoid plunger 20. Adjacent to plunger 20 is another plunger 26 which is also driven by solenoid 17. Plunger 26 has connected thereto a cam and cam follower which engages paper 11 with a thermal printhead assembly 10 (not shown in FIG. 1) disposed over the cam follower and paper 11.

Figure 2:
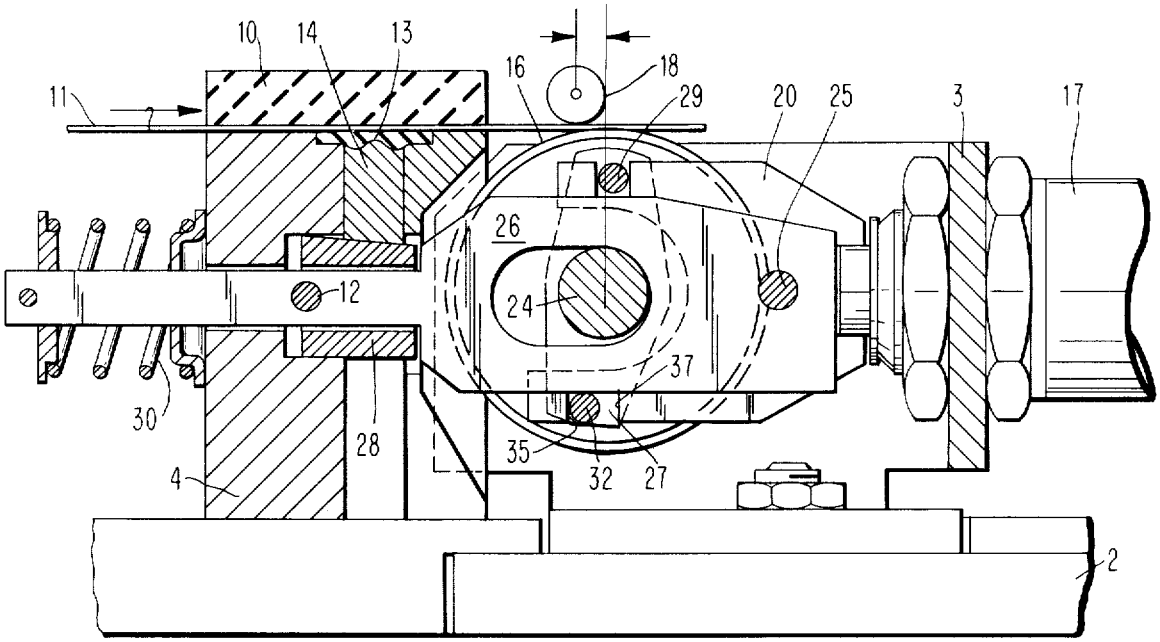
FIG. 2 is a side view, partially in section, of my novel mechanism.
Figure 3:
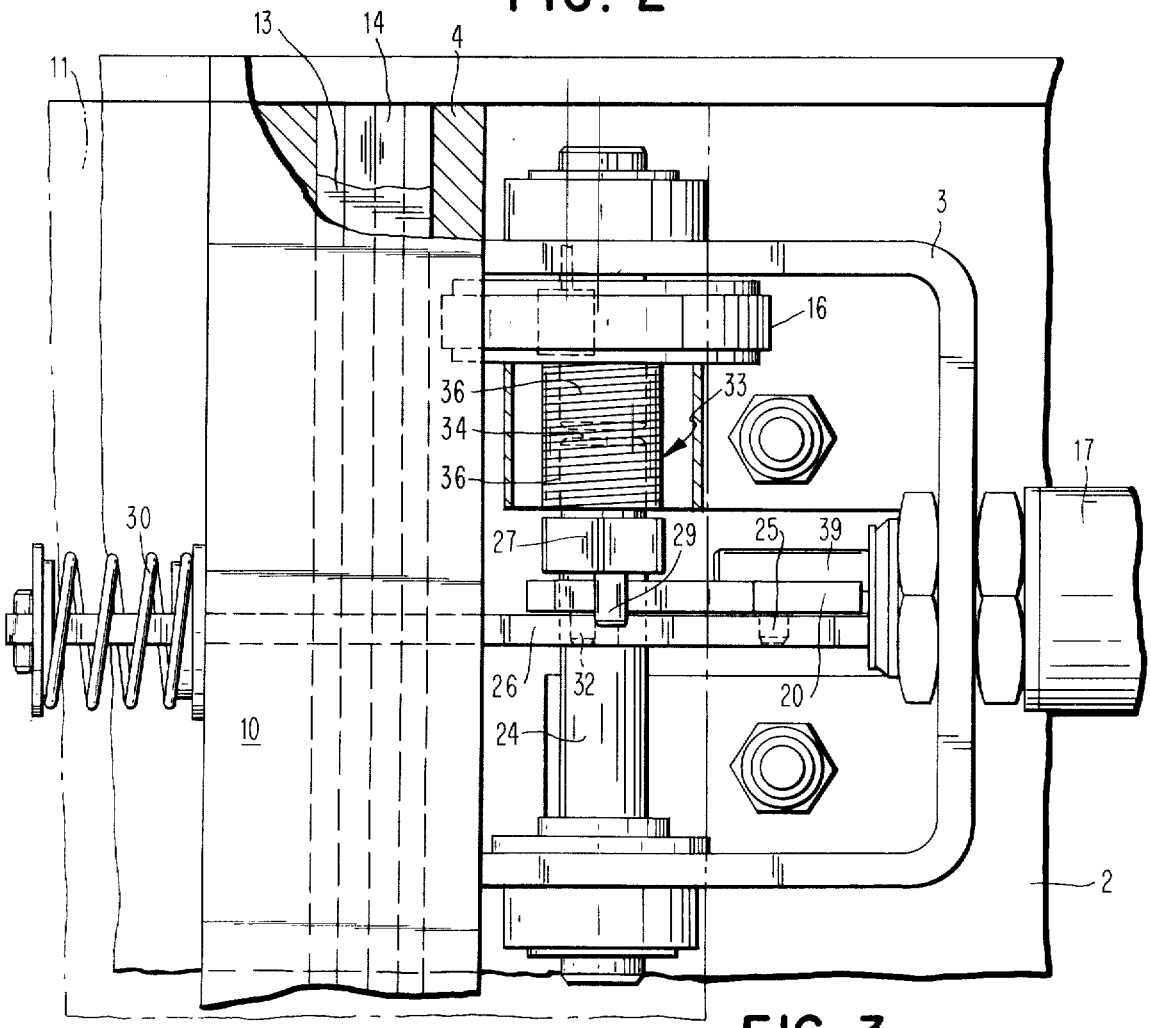
FIG. 3 is a top view, partially in section, of the mechanism.
Figure 4:
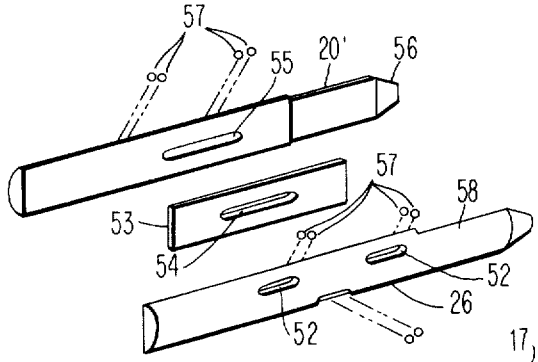
FIG. 4 is an exploded view of a novel segmented plunger which serves as the actuator for the sheet advancing mechanism.

FIGS. 2 and 3 of the drawing illustrate my incremental advance mechanism in more detail. Solenoid 17 actuates simultaneously a pair of plungers 20 and 26 which comprise actuator means for the mechanism. Plunger 20 has the shape of a yoke containing upper and lower notches which engage pins 29 and 32, respectively. Pins 29 and 32 are connected to a toggle plate 27 which functions as a reciprocating means in response to the linear motion of yoke 20 upon energization and deenergization of solenoid 17.

Toggle plate 27 engages web advancing roller 16 by means of a split hub 36 around which is wound a helical spring 34. The split hub and helical spring mechanism, contained in housing 33, thereby functions as a spring clutch responsive to the motion of toggle 27 for rotating the roller 16 in one direction only. In the preferred embodiment shown roller 16 rotates clockwise. The spring clutch illustrated in FIG. 3 is well known to those skilled in the art as being an inexpensive but highly reliable means for intermittent indexing. As will be discussed in a later section of the specification, other clutch mechanisms are also suitable for use in my advance mechanism, although from the cost-performance standpoint the spring clutch is superior at the present state of the art. In addition, it will be understood that the particular geometric design of toggle plate 27 and yoke 20 may be changed without affecting the fundamental operation of my invention. However, from the standpoint of compactness and reliability, the present geometric design appears to be ideal.

Plunger 26 is also carried by common shaft 24 for reciprocating motion in response to solenoid 17. Plunger 26 engages cam strip 28 by means of pins 12. Motion of strip 28 produces a vertical displacement of knife-edge wedge 14, the latter thereby operating as the cam follower responsive to strip cam 28. At its apex, wedge 14 engages diaphragm 13 which is fixed on its sides to housing section 4. When so engaged by wedge 14 diaphragm 13, which may be any suitable rubber or rubber-like composition, presses against sheet 11 to thereby engage sheet 11 to print head 10. Compression spring 30 engages plunger 26 and forces cam 28 to its lowermost position with respect to follower 14, i.e., leftward, upon deenergization of solenoid 17.

Spring loaded roller 18 is oriented eccentrically with respect to the vertical axis passing through roller 16 and shaft 24. This eccentric displacement produces a torque which is counter to the incremental advance of roller 16. This helps to ensure the locking of the unidirectional clutch after each incremental movement.

Operation of the Invention

The sequence of operation of the mechanism can be conveniently divided into a deenergized period and three active cycles: (1) advance (2) print and (3) deactivation.

During the deenergized period, solenoid 17 is in a deenergized state and plungers 20 and 26 are held in their leftmost positions, furthest away from solenoid 17 by spring 30. The relative positions of pins 29 and 32 with respect to the vertical axis of roller 16 and common shaft 24 are reverse of those shown in FIG. 2; i.e., pin 29 is to the left of pin 32, and side 37 of the lower notch of plunger 20 engages pin 32. Wedge 14 is located at the lowest portion of the upper surface of cam strip 28 so as not to engage diaphragm 13. Diaphragm 13 thus provides no pressure to sheet 11 for engagement with print head 10.

During the advance cycle, upon energization of solenoid 17, plungers 20 and 26 are both drawn toward the solenoid, thereby biasing spring 30. Pin 29 is chordally displaced within the upper notch of plunger 20 until the pin 32 engages side 35 of the lower notch, which prevents further displacement.

Spring clutch 33 transmits the motion of toggle 27 to roller 16, thereby producing in roller 16 an arcuate displacement directly proportional to the linear motion of plunger 20. In an actual embodiment of the invention, plunger 20 moves laterally for a distance of ⅜mm to impart a circumferential movement of ⅝mm to paper 16. As previously discussed, eccentrically loaded roller 18 produces a torque counter to this advance and insures the locking of clutch 33 after the incremental step.

The simultaneous motion of plunger 26 toward solenoid 17 draws cam strip 28 to the right, thereby causing cam follower 14 to engage diaphragm 13, which in turn presses sheet 11 against the print head 10. Spring 30 is biased at this point. Printing on sheet 11 be energization of print heads 10 in the standard manner is accomplished at this portion of the operation cycle.

After printing is completed, during the deactivation cycle solenoid 17 is deenergized, thereby allowing spring 30 to decompress, pulling plungers 20 and 26 leftward to their initial positions. The positions of pins 29 and 32 are reversed with respect to the center axis of roller 16; however, overrunning spring clutch 33 does not transmit the motion of the pins in this direction to roller 16; thus, roller 16 will remain motionless upon deenergization of solenoid 17. Wedge 14 is forced down the ramp surface of cam 28 by the energy stored in resilient pad 13 and paper 11 is disengaged from print head 10.

It will be appreciated that the operation is quite simple as compared to prior art mechanisms. Although other actuating means may be used, active control is attained in the preferred embodiment by a single solenoid of unique design; thereby reducing the control circuitry to the barest minimum. In addition, print head 10 remains stationary; the paper alone moves, making for reliable operation. Moreover, the entire mechanism is compact and may be contained completely within the housing of the system in which it is used, e.g., a calculator.

Turning now to FIGS. 4 and 5A–5C, there is shown a multi-stroke plunger assembly of novel design which is employed within solenoid 17. The segmented plunger is capable of independent and variable linear displacement of the segments within a common electromagnetic field. Plunger segments 20' and 26' correspond to the portions of plungers 20 and 26, respectively, within solenoid 17 of FIGS. 2 and 3. Plunger segments 20' and 26' within the solenoid housing are separated by a non-magnetic material 53 having a slot 54 so as to permit a key 60, which is also non-magnetic attached to the wall of segment 26', to pass through slot 54 and to engage slot 55 in segment 20'. The differential between the key length and the slot length determines the relative displacement of one segment with respect to the other. The relative position of key 60 with respect to slot 55 controls delay or lost motion.

An important requirement for the proper and full differential travel between segments 20' and 26' is adequate flux path isolation. Differential displacement is not possible without the appropriate undercuts 56 and 58 located in the pole face regions of the segments. The undercuts effectively increase the magnetic reluctance between the segment ends at the pole face and preclude the shorting of the magnetic flux path of a segment in transit to fully transferred segment having a minimum gap condition.

Figure 5A:
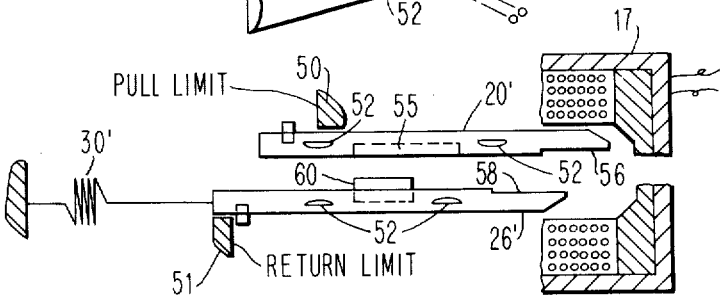
FIGS. 5A–5C are top surface views of the segmented plunger of FIG. 4 which illustrate its operation.

Upon energization of the solenoid field coil, segments 20' and 26' become magnetically polarized and result in repulsive magnetic reactions between the segment ends. The radial displacement of the segments produces considerable friction between the segment surface and non-magnetic plunger cavity liner 53. This frictional resistance to displacement is effectively nullified by locating a suitable number of non-magnetic balls 57 in slots 52 on the segment surfaces, so as to result in a linear bearing transport system. The relationship between ball circumference, slot length and displacement is correlated so as to result in rolling rather than skidding action of balls 57. In FIG. 5A, solenoid 17 is deenergized and spring 30' forces segment 26' against return limit 51. Segment 20' is also displaced by spring 30' through key 60 which engages slot 55.

Figure 5B:
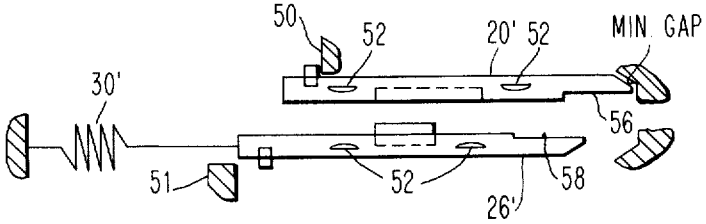
Figure 5C:
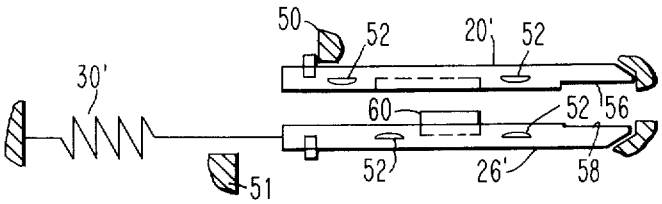

FIGS. 5B and 5C show the segments partially and fully transferred, respectively, when solenoid 17 is energized, which tends to pull both segments rightward. The travel of segment 20' is limited by pull limit 50, which also limits the travel of segment 26' through the engagement of key 60 is slot 55. As previously noted, the differential between the lengths of key 60 and slot 55 allows a greater displacement of segment 26' than segment 20'. In the incremental advance mechanism of FIGS. 2 and 3, the greater displacement of plunger 26 than plunger 20 allows the displacement of cam follower 14 to be greater than the short incremental displacement required of roller 16. This is an obvious engineering advantage, as the specifications for the paper print head engagement means are relatively independent of the specification of the reciprocating means. In addition, the slot and key arrangement allows the motions of the plungers to be sequential.

Limits 50 and 51 are preferrably associated with solenoid 17 as shown in FIGS. 5A–5C. This is particularly important with respect to limit 50 which ensures a minimum gap condition of the segments from the solenoid walls when the latter is energized. However, the functions of limits 50 and 51 may be performed by other portions of the incremental advance mechanism.

Figure 6:
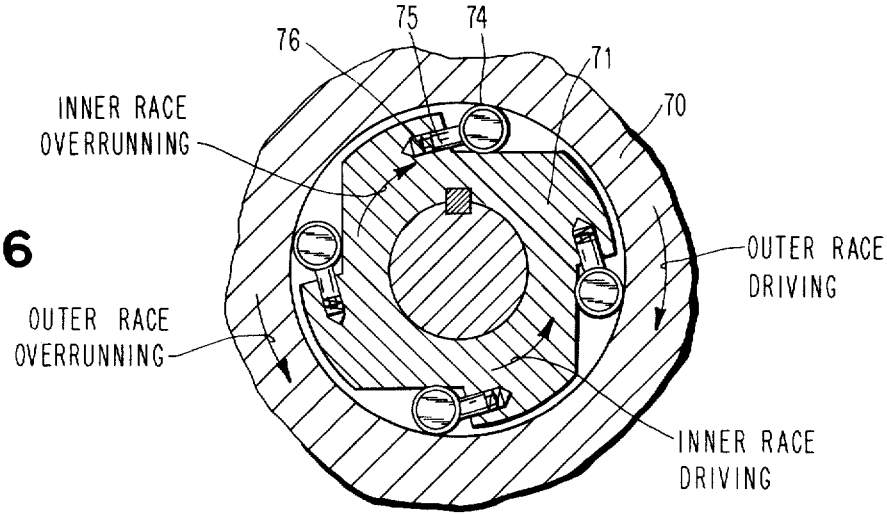
FIG. 6 is a sectional view of a roller-ramp clutch which is suitable for use in my advance mechanism.

FIG. 6 illustrates another type of clutch which may be used to respond to the reciprocating toggle for causing unidirectional incremental motion of the roller. The clutch is commonly termed a roller-ramp clutch which is commercially available. It operates on the principle of a roller on an inclined plane in which rollers 74 are kept in engagement with the clutch inner and outer races 71 and 70, respectively, through plungers 75 which are biased by springs 76. When outer race 70 is driven counterclockwise, inner race 71 is disengaged, because rollers 74 are forced down the inclined ramp, permitting a freewheeling of the clutch. In this direction, the races move rollers 74 in an anti-wedge position whereby plungers 75 keep rollers 74 in light contact with the races. When outer race 70 is driven clockwise, inner race 71 being driven clockwise, rollers 74 are forced up the incline or ramps, thereby locking the race and the roller components to transmit load. Although roller ramp clutches could be used very effectively in my invention, they are at present much more expensive than the spring clutches already described and, therefore, are not the preferred means for providing unidirectional motion.

In addition to the clutch mechanism already described, it will be obvious to one skilled in the art that other types of clutches such as cam clutches might also be used to good effect.

While the invention has been particularly shown and described with reference to a preferred embodiment thereof, it will be understood to those skilled in the art that the foregoing and other changes in form and detail may be made therein without departing from the spirit or the scope of the invention.

For example, the preferred embodiment has been described in terms of line-at-a-time thermal printing. However, the apparatus is obviously adaptable for other types of printing as well as for character, bar segment or dot printing. In addition, it is adaptable for use in any sheet advancing system which requires a low cost, reliable incremental advance mechanism.

I claim:

1. Apparatus for incrementally advancing a sheet comprising:

a sheet-advancing roller mounted for rotation;

actuator means;

reciprocating means responsive to said actuator means for providing limited reciprocating motion;

clutch means responsive to said reciprocating means for rotating said roller unidirectionally for a desired increment determined by the motion of said reciprocating means; and means responsive to said actuator means for engaging said sheet upon the completion of the incremental motion of said sheet;

said actuator means comprising:

a solenoid containing a segmented plunger, one segment connected to said reciprocating means, the other segment connected to said sheet engaging means;

one of said segments containing a slot and the other of said segment keyed into said slot, the length of said slot being greater than the length of said key;

said segments being undercut at adjacent ends to increase the magnetic reluctance therebetween;

whereby said segments are capable of differential displacement depending on the difference between the respective lengths of said slot and said key.

2. A system as in claim 1 wherein said clutch means comprises:

a split hub connected between said roller and said reciprocating means; and a close-wound spring helically girding said hub.

3. A system as in claim 1 wherein said clutch means comprises a roller-ramp clutch connected to said advancing roller and engaged by said reciprocating means.

4. A system as in claim 1 wherein said sheet is frictionally engaged between said advancing roller and a spring-loaded roller which is rotatably mounted eccentrically with respect to the center axis of said advancing roller.

5. Apparatus for incrementally advancing a sheet comprising:

a sheet-advancing roller mounted for rotation;

actuator means;

reciprocating means responsive to said actuator means for providing limited reciprocating motion;

clutch means responsive to said reciprocating means for rotating said roller unidirectionally for a desired increment determined by the motion of said reciprocating means; and means responsive to said actuator means for engaging said sheet upon the completion of the incremental motion of said sheet;

said sheet engaging means comprising cam means and cam follower means, said cam means being carried by said actuator means;

said cam follower means comprisng means for displacing said sheet along an axis orthogonal with respect to the incremental motion of said sheet.

6. Apparatus as in claim 5 wherein said cam means is a ramp, said cam follower means is a knife-edge wedge mounted for movement along the surface of the ramp, and further comprising:

resilient means disposed between said knife-edge and said sheet.

7. Apparatus for incrementally advancing a sheet comprising:

a sheet-advancing roller mounted for rotation;

actuator means;

reciprocating means responsive to said actuator means for providing limited reciprocating motion;

said reciprocating means being a toggle plate connected to said clutch means and including a pair of pins connected on each end of the knee of said toggle, said pins being engaged by said actuator means;

clutch means responsive to said reciprocating means for rotating said roller unidirectionally for a desired increment determined by the motion of said reciprocating means; and means responsive to said actuator means for engaging said sheet upon the completion of the incremental motion of said sheet.

8. In apparatus for incrementally advancing thermally sensitive record material past thermal print means which comprises a row of heating elements and where printing occurs upon the engagement of said print heads and said material and the energization of selected ones of said heating elements, the improvement comprising:

a roller for carrying said material and mounted for rotation;

actuator means;

reciprocating means responsive to said actuator means for providing limited reciprocating motion;

clutch means responsive to said reciprocating means for rotating said roller unidirectionally for a desired increment determined by the motion of said reciporcating means; and means responsive to said actuator means for moving said material into engagement with said thermal printing heads upon the completion of the incremental motion of said material.

9. Apparatus as in claim 8 wherein said actuator means comprises:

a solenoid containing a segmented plunger, one segment connected to said reciprocating means, the other segment connected to said material engaging means.

10. Apparatus as in claim 9 wherein:

one of said segments contains a slot and the other of said segments is keyed into said slot, the length of said slot being greater than the length of said key;

said segments being undercut at adjacent ends to increase the magnetic reluctance therebetween;

whereby said segments are capable of differential displacement depending on the difference between the respective lengths of said slot and said key.

11. System as in claim 8 wherein said clutch means comprises:

a split hub connected between said roller and said reciprocating means; and a close-wound spring helically girding said hub.

12. A system as in claim 8 wherein said clutch means comprises a roller-ramp clutch connected to said advancing roller and engaged by said reciprocating means.

13. Apparatus as in claim 8 wherein said material is frictionally engaged between said advancing roller and a spring-loaded roller which is rotatably mounted eccentrically with respect to the center axis of said advancing roller.

14. Apparatus as in claim 8 wherein said material engaging means comprises cam means and cam follower means, said cam means being carried by said actuator means;

said cam follower means for displacing said material along an axis orthogonal with respect to the incremental motion of said paper.

15. Apparatus as in claim 14 wherein said cam means is a ramp, said cam follower means is a knife-edge wedge mounted for movement along the surface of the ramp and further comprising:

resilient means disposed between said knife-edge and said material whereby said knife-edge urges said material into contact with said printing heads by means of said resilient means when said knife-edge is at the uppermost portion of said ramp.

16. Apparatus as in claim 8 wherein said reciprocating means is a toggle plate connected to said clutch means including a pair of pins connected on each end of the knee of said toggle, said pins being engaged by said actuator means.

17. Apparatus for incrementally advancing record material comprising:

a material-advancing roller mounted for rotation;

a spring-loaded roller which is rotatably mounted eccentrically with respect to the center axis of said advancing roller, said material being frictionally engaged between said rollers;

actuator means including a solenoid containing first and second plungers;

reciprocating means connected to said first plunger for providing limited reciprocating motion;

clutch means responsive to said reciprocating means for rotating said roller unidirectionally for a desired increment determined by the motion of said reciprocating means; and cam means and cam follower means connected to said second plunger for engaging said material upon the completion of the incremental motion of said material.

18. Apparatus as in claim 17 wherein: ddddd said second plunger contains a slot and said first plunger is keyed into said slot, the length of said slot being greater than the length of said key;

said plungers being undercut at adjacent ends to increase the magnetic reluctance therebetween;

whereby said plungers are capable of differential displacement depending on the difference between the responsive lengths of said slot and said key.

19. Apparatus as in claim 18 wherein said cam means is a ramp engaged by said second plunger and said cam follower means is a knife-edge wedge mounted for movement along the surface of the ramp, and further comprising:

resilient means disposed between said knife-edge and said record material.

* * * * *